US006470802B1

(12) United States Patent
Neyer et al.

(10) Patent No.: US 6,470,802 B1
(45) Date of Patent: Oct. 29, 2002

(54) MULTILAYER CHIP SLAPPER

(75) Inventors: Barry T. Neyer, Cincinnati, OH (US); Robert Tomasoski, Centerville, OH (US); Robert Tetreault, Pointe-Claire (CA); George Papadopoulos, Dollard Des Ormeaux (CA)

(73) Assignee: PerkinElmer, Inc., Wellesley, MA (US)

( * ) Notice: Subject to any disclaimer, the term of this patent is extended or adjusted under 35 U.S.C. 154(b) by 0 days.

(21) Appl. No.: 09/885,146

(22) Filed: Jun. 20, 2001

(51) Int. Cl.[7] ..... F42B 3/10
(52) U.S. Cl. ..... 102/202.5
(58) Field of Search ..... 102/202.5, 202.2, 102/202.14

(56) References Cited

U.S. PATENT DOCUMENTS 4,708,060 A * 11/1987 Bickes et al. ..... 102/202.5
4,788,913 A * 12/1988 Stroud et al. ..... 102/202.5
4,852,493 A * 8/1989 Boberg et al. ..... 102/202.5
4,862,803 A * 9/1989 Nerheim et al. ..... 102/202.5
5,370,053 A * 12/1994 Williams et al. ..... 102/202.14
5,370,054 A * 12/1994 Reams et al. ..... 102/202.2
5,789,697 A * 8/1998 Engelke et al. ..... 102/202.5
5,969,286 A * 10/1999 Ward et al. ..... 102/202.14
6,158,347 A * 12/2000 Neyer et al. ..... 102/202.14
6,178,888 B1 * 1/2001 Neyer et al. ..... 102/202.14
6,230,625 B1 * 5/2001 Neyer et al. ..... 102/200
6,234,081 B1 * 5/2001 Neyer ..... 102/200
6,374,739 B1 * 4/2002 Smith et al. ..... 102/201

* cited by examiner

*Primary Examiner*—Charles T. Jordan
*Assistant Examiner*—Jordan M Lofdahl
(74) *Attorney, Agent, or Firm*—Iandiorio & Teska

(57) ABSTRACT

A chip slapper including a substrate, a sticking layer on the substrate, a conductive layer on the sticking layer in the shape of two lands separated by a bridge portion between the two lands, a buffer material on the conductive layer, a protective coating on the buffer layer extending across at least a substantial portion of the two lands but absent from the bridge portion, and a flyer layer over the bridge portion. The buffer layer prevents migration of the material of the coating into the material of the conductive layer and vice versa and better adheres the flyer layer on the bridge portion where the coating is absent.

29 Claims, 6 Drawing Sheets

MULTILAYER CHIP SLAPPER

FIELD OF THE INVENTION

This invention relates generally to devices for setting off an explosive charge and more particularly to a chip slapper type detonator.

BACKGROUND OF INVENTION

Chip slapper type detonators in general cause a "flying plate" to be propelled at a high velocity against a secondary explosive medium creating a shock wave which results in the detonation of the secondary explosive. In a typical design, there are two wide area conductive lands separated by a narrow rectangular bridge member. The lands are connected to a capacitor through a high voltage switch. When the switch closes, the capacitor provides current across the lands which vaporizes the bridge member turning into a plasma. This plasma accelerates a portion of the dielectric material covering the bridge member to a high velocity, causing it to slap into an explosive. The resulting shock wave causes detonation of the explosive.

Traditional chip slappers include a ceramic substrate and a copper conductive layer on one surface of the substrate in the shape of the two wide lands separated by the narrow bridge portion. There may be a protective gold coating on the copper to prevent the copper conductive layer from corroding and to enhance electrical connections made to the lands. A flyer layer made of polyimide is then secured over the bridge portion.

There are several potential problems associated with this current design. First, the flyer layer does not exhibit an affinity for the gold coating and may not properly stick in place on the bridge portion. Second, the gold of the coating can migrate into the copper of the conductive layer and vice versa. The result is that the gold coating loses its corrosion prevention ability and its ability to enhance the electrical connections to the lands. Also, when the copper material migrates into the gold, there is a higher susceptibility to corrosion.

SUMMARY OF THE INVENTION

It is therefore an object of this invention to provide an improved chip slapper.

It is a further object of this invention to provide such an improved chip slapper in which the flyer layer is more easily and securely affixed over the bridge portion of the chip slapper.

It is a further object of this invention to provide such an improved chip slapper which prevents the gold of the protective coating for migrating into the copper of the conductive layer and vice versa.

It is a further object of this invention to provide such an improved chip slapper which is thus more resistant to corrosion.

It is a further object of this invention to provide such an improved chip slapper in which the gold coating retains its electrical connection enhancement ability.

It is a further object of this invention to remove the gold from the bridge area to improve the energy efficiency of the detonator.

The invention results from the realization that adding a buffer material between the gold coating and the conductive copper of the lands of the chip slapper prevents the gold from migrating into the copper and vice versa thus retaining the corrosion resistance properties of the gold and the electrical properties of the copper and from the further realization that if the gold coating is removed from the bridge portion of the copper between the lands, the exposed buffer material assists in adhering the flyer plate to the bridge portion, prevents the etchants used in the manufacturing process from adversely affecting the copper, and, in addition, less energy is required to make a plasma which accelerates a portion of the flyer layer (i.e., the "flying plate" ) into an explosive. Thus, one of the advantages of the chip slapper design of the subject invention is that for a given energy input to the slapper, it is able to provide a larger shock wave to detonate the explosive and, conversely, less energy is required to provide the same shock wave to an explosive as a conventional bridge, and, as a result, smaller systems can be designed.

This invention features a chip slapper comprising a substrate; a sticking layer on the substrate; a conductive layer on the sticking layer in the shape of two lands separated by a bridge portion between the two lands; a buffer material on the conductive layer; a coating on the buffer layer extending across at least a substantial portion of the two lands but absent from the bridge portion; and a flyer layer over the bridge portion. The buffer material advantageously prevents migration of the material of the coating into the material of the conductive layer and vice versa and also better adheres the flyer layer on the bridge portion where the coating is absent.

The substrate is typically made of a ceramic material, the sticking layer may be made of a titanium-tungsten composition, the conductive layer is typically made of copper, the buffer material may also be made of a titanium-tungsten composition, the coating may be gold, and the flyer layer is typically a polyimide material. In the preferred embodiment, the material of sticking layer and the buffer material are the same. This invention also features a chip slapper with at least a substrate; a conductive layer on the substrate in the shape of two lands separated by a bridge portion between the two lands; a coating on the lands of the conductive layer but absent from the bridge portion; and a flyer layer over the bridge portion.

Further included may be a sticking layer on the substrate under the conductive layer to adhere the conductive layer to the substrate, and a buffer material between the coating and the conductive layer to prevent migration of the material of the coating into the material of the conductive layer and vice versa in the area of the lands. In the preferred embodiment, the buffer material extends across the bridge portion where the coating is absent to promote adhesion of the flyer layer to the bridge portion.

This invention also features a chip slapper with at least a substrate; a conductive layer on the substrate in the shape of two lands separated by a bridge portion between the two lands; a buffer material on at least the bridge portion of the conductive layer; and a flyer layer over the bridge portion such that the buffer layer promotes adhesion of the flyer layer to the conductive layer.

Further included may be a protective coating on the lands of the conductive layer to protect the conductive layer against corrosion in the area of the two lands but absent from the bridge portion to facilitate securing the flyer layer to the bridge portion. In the preferred embodiment, the buffer material extends between the conductive layer and the protective coating in the area of the lands to prevent migration of the material of the protective coating into the material of the conductive layer and vice versa. There may also be a sticking layer between the substrate and the conductive layer to promote adhesion between the conductive layer and the substrate.

One method of making the chip slapper of the subject invention is to deposit a sticking layer on a substrate, a conductive layer on the sticking layer, and depositing a buffer material on the conductive layer and to coat the conductive layer; then etch the sticking layer, the conductive layer, the buffer layer, and the coating into the shape of two lands separated by a bridge portion between the two lands; remove the coating from the bridge portion to reveal the buffer material; and then attach a flyer layer to the bridge portion.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
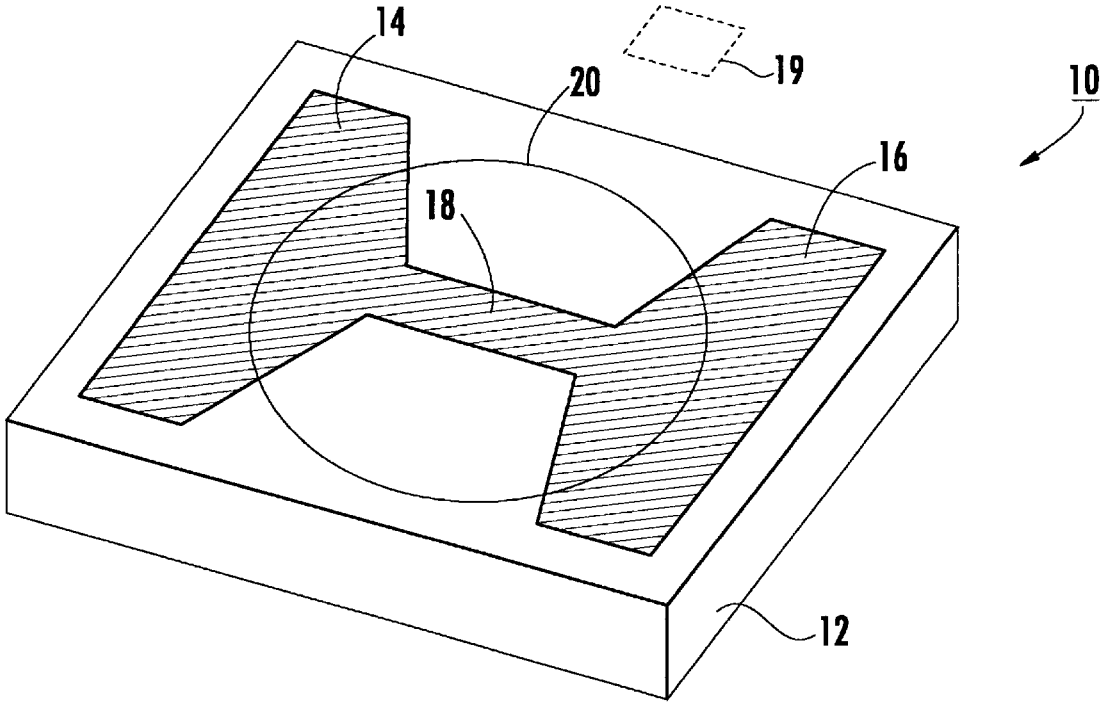
FIG. 1. (PRIOR ART)
FIG. 1 is a top view of a prior art chip slapper.

Conventional chip slapper 10, FIG. 1 includes ceramic substrate 12 upon which is deposited metal film such as copper etched into the shape of spaced wide area conductive lands 14 and 16 and narrow bridge portion 18 extending therebetween.

Flyer layer 20 (shown in FIG. 1 to be transparent for illustrative purposes), for example, a dielectric coating such as polyamide or "Kapton", is applied over bridge portion 18 as shown.

In use, lands 14 and 16 are connected to a suitable voltage source and when several thousand volts are applied to the lands, bridge portion 18 vaporizes and is turned into a plasma. This plasma accelerates a small portion 19 of the flyer layer ("the flying plate" ) away from substrate 12 and towards an explosive. The shock of flying plate 19 striking the explosive then detonates the explosive.

A gold coating may be deposited on the top surface of the copper lands and the bridge portion in the prior art to prevent the copper from corroding and to enhance the electrical connections made to lands 14 and 16.

As stated in the Background of the Invention section above, however, the design shown in FIG. 1 has several possible shortcomings. First, flyer layer 20 does not exhibit an affinity for the gold coating and may not properly stick in place on bridge portion 18. Second, the gold of the coating can migrate into the copper of the conductive layer and vice versa. The result is that the gold loses its corrosion prevention ability and also its ability to enhance the electrical connections to the lands. Moreover, if the copper migrates into the gold, the copper is then more susceptible to corrosion.

Figure 2:
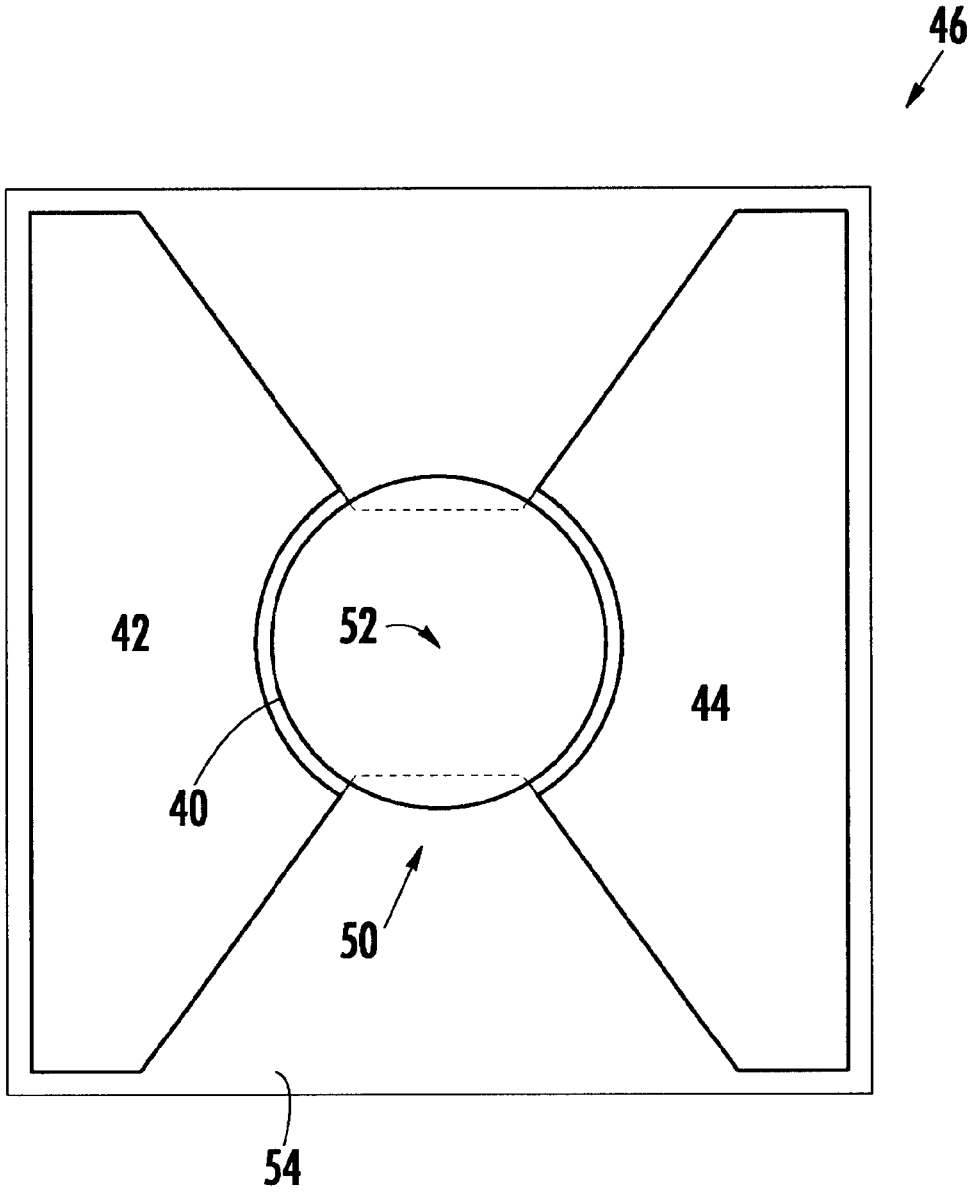
FIG. 2 is a top view of the chip slapper of the subject invention.

In the subject invention, buffer layer 40, FIG. 2 is added between the conductive (e.g., copper) material of lands 42 and 44 of chip slapper 46 and the gold coating to prevent the gold from migrating into the copper and vice versa to thus retain the corrosion resistance properties of the gold and the electrical properties of the copper. Furthermore, the gold coating is preferably removed or otherwise absent from bridge portion 50 of the copper between lands 42 and 44 to expose buffer layer 40 which assists in adhering flyer plate 52 to bridge portion 50. Buffer layer 40 also prevents etchants used in the manufacturing process from adversely effecting the copper. Moreover, by removing the gold coating from bridge portion 52, less energy is required to generate a plasma which accelerates the flying plate into an explosive. In this way, less energy is required as an input to chip slapper 46 of the subject invention to provide a large shock wave to detonate an explosive. Conversely, less energy is required to provide the same shock wave to an explosive as a conventional chip slapper as shown in FIG. 1 and, as a result, smaller chip slappers and their associated circuitry can be designed.

Thus, chip slapper 46 includes ceramic substrate 54 (e.g., 0.10" on a side or in diameter), an optional sticking layer on the top surface of substrate 54 (e.g., a titanium tungsten composition typically 100 Angstroms thick), a two to four micron thick conductive copper layer in the shape of wide area lands 42 separated by narrow bridge portion 50 extending between wide area lands 42 and 44, and a buffer material 40 on the conductive copper lands and the bridge portion underneath the protective coating (e.g., gold).

Buffer layer 40 may also be a titanium-tungsten composition typically 500 Angstroms thick. The top most layer is then a gold coating on the buffer layer. But, in the preferred embodiment, the gold coating is absent from bridge portion 50 thus exposing buffer layer 40 as shown in FIG. 1. In this way, when polyimide flyer layer 52 (10 to 25 $\mu$thick) is placed over bridge portion 50, it adheres better via buffer layer 40 to the copper material of the conductive layer.

The gold coating preferably extends across at least a substantial portion of lands 42 and 44 but it is prevented from migrating into the copper of the conductive layer in the area of lands 42 and 44 due to the presence of the buffer material between the gold coating and the copper. As shown in FIG. 1, buffer material 40 is exposed in a circular configuration by removing the gold coating over all of bridge portion 50 and a small part of each land 42 and 44. In this way, flyer layer 52 is easier to secure over bridge portion 50 since the material of flier layer 52 exhibits a greater affinity for the buffer material than for gold.

Figure 3:
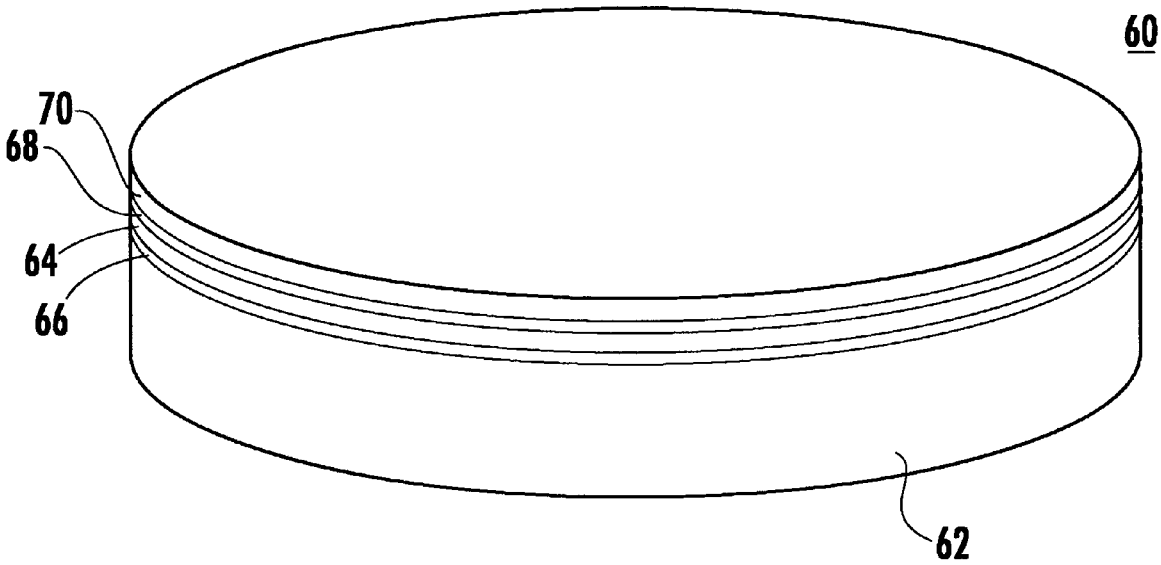
FIG. 3 is a schematic view of a multi-layer wafer used to manufacture a number of chip slappers in accordance with the subject invention.
Figure 4:
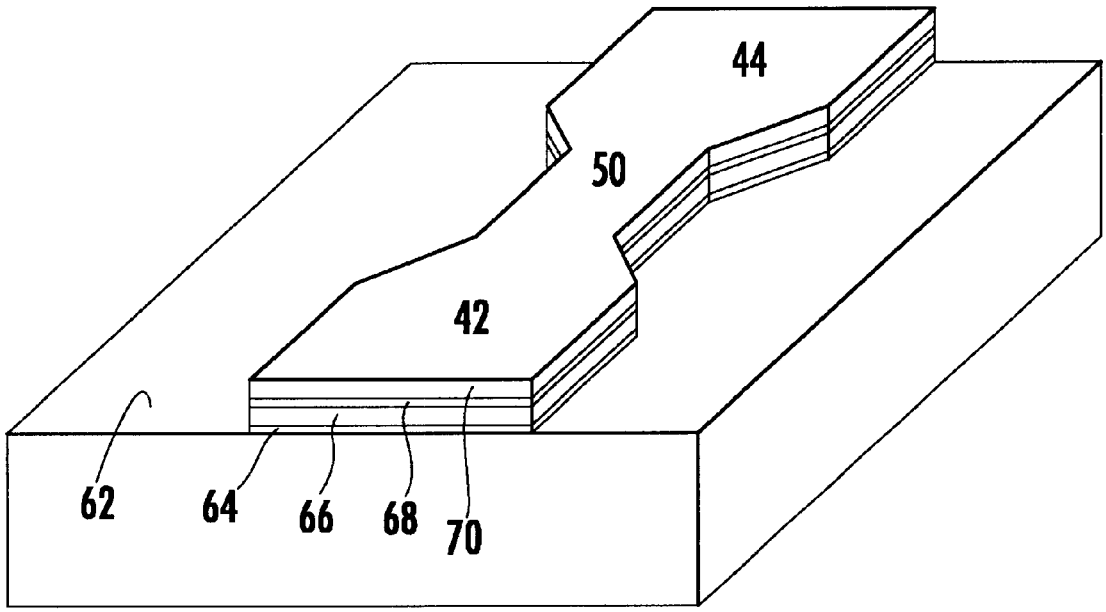
FIG. 4 is a schematic view of a portion of the wafer shown in FIG. 3 after the metal layers are etched to form the conductive lands and the bridge portion of an individual chip slapper in accordance with the subject invention.
Figure 5:
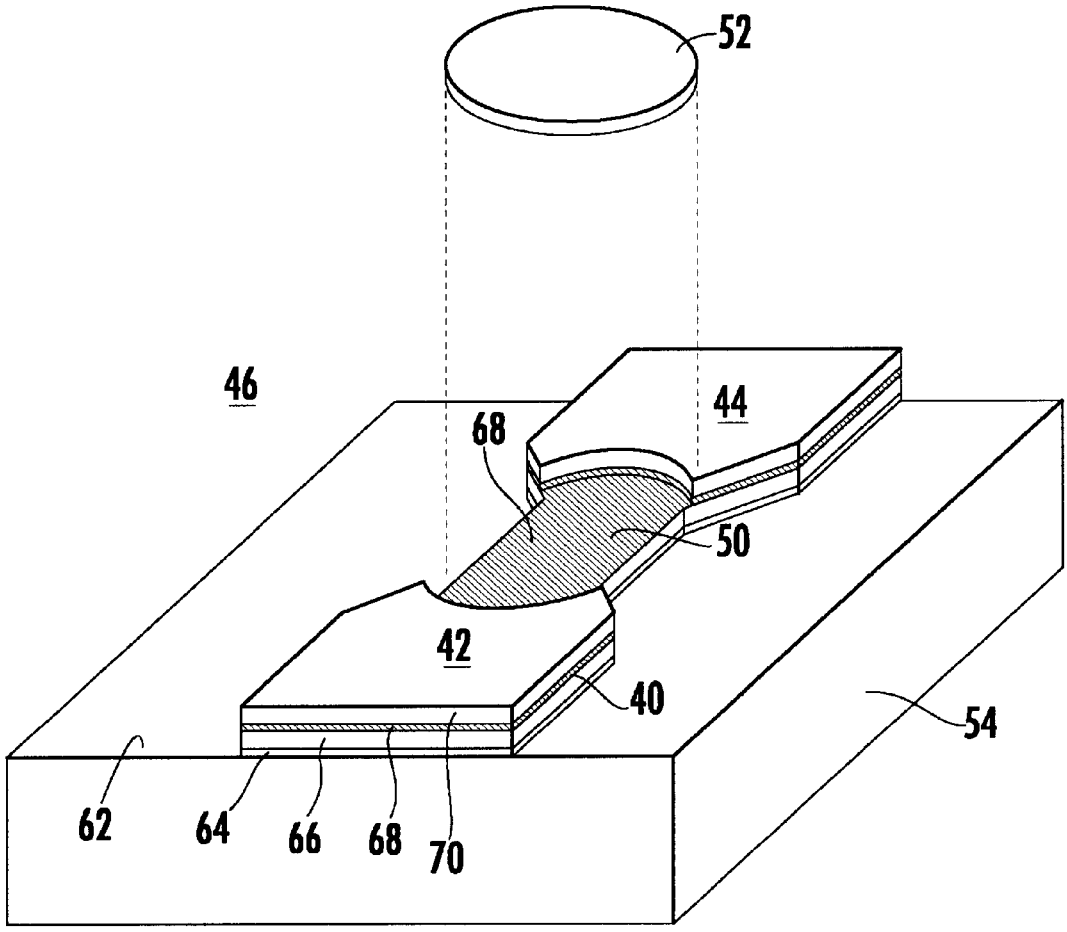
FIG. 5 is a view similar to FIG. 4 except that now the gold coating is removed from the bridge portion of the chip slapper in accordance with this invention.

In FIGS. 3 through 5 the thickness of the relative layers are exaggerated for the purposes of illustration.

Manufacturing a chip slapper in accordance with the subject invention begins with wafer 60, FIG. 3 which includes ceramic layer 62, titanium tungsten sticking layer 64, copper conductive layer 66, buffer layer 68, and gold coating 70. Wafer 60 was manufactured by a third party in accordance with the applicant's specifications (see steps 200, 202, 204, and 206, FIG. 6) and used to fabricate a number of chip slappers 46, FIG. 1 in accordance with the following methodology.

Figure 6:
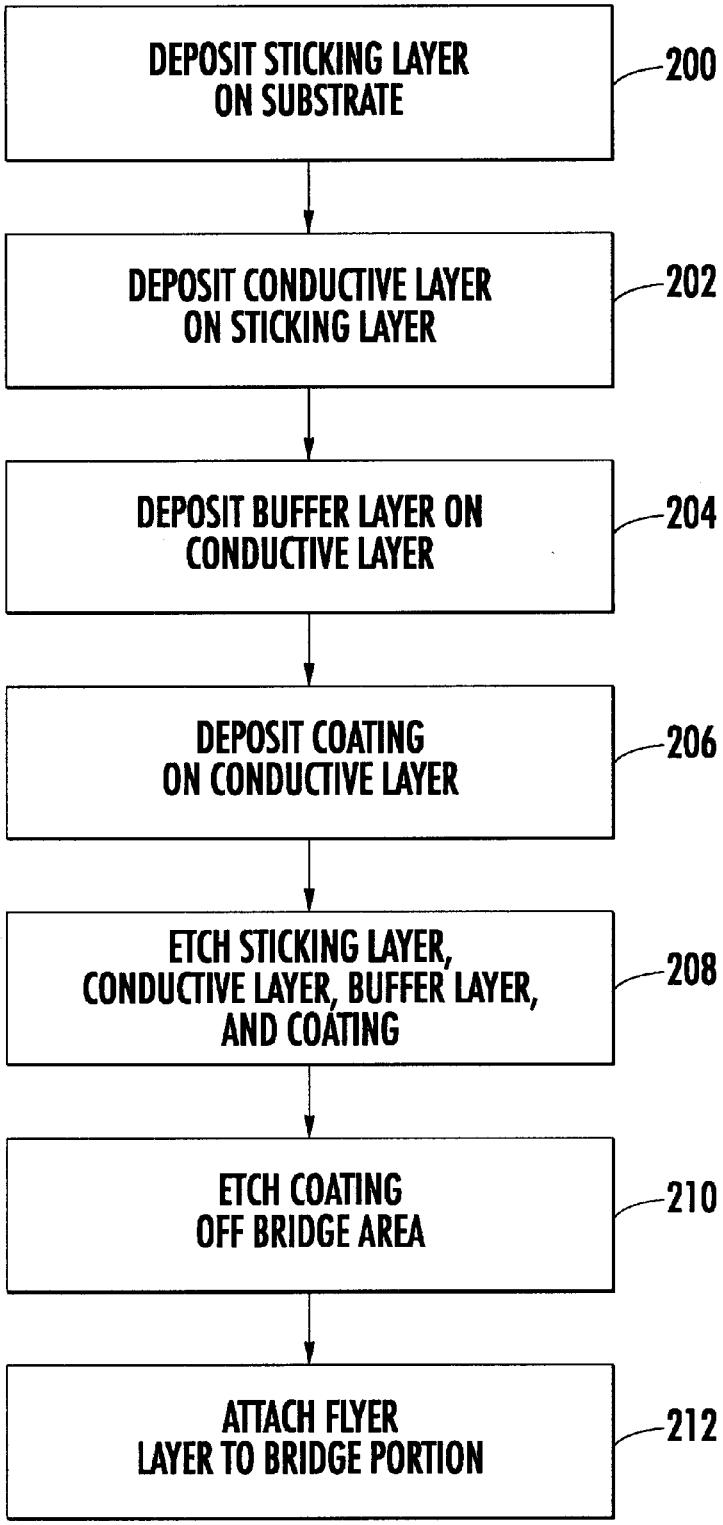
FIG. 6 is a flow chart depicting the primary steps associated with the preferred method of manufacturing the chip slapper shown in FIG. 2 in accordance with the subject invention.

First, for each chip slapper, gold coating 70, buffer layer 68, copper conductive layer 66, and sticking layer 64 were etched, step 208, FIG. 6, as shown in FIG. 4 to form wide land areas 42 and 44 and narrow bridge portion 50. In FIG. 4, only one chip slapper is shown but it is to be understood that wafer 60, FIG. 3 includes a number of chip slappers as shown in FIG. 4.

Next, step 210, FIG. 6, gold coating layer 70 is etched off bridge portion 50 exposing buffer material 68 as shown in FIG. 5. Flyer layer 52 is secured to bridge portion 50 of each chip slapper, step 212, FIG. 6. The individual chip slappers are cut from the wafer.

Thus, chip slapper 46, FIG. 5 includes substrate 54 formed of layer 62, sticking layer 64 on substrate 54, conductive layer 66 on sticking layer 64 in the shape of lands 42 and 44 separated by bridge portion 50 between lands 42 and 44. A buffer layer formed from buffer material 68 is on conductive layer 66 and conductive coating 70 is over buffer layer 40. Coating 70, as explained above, typically extends across at least a substantial portion of lands 42 and 44 but is absent from all or a substantial portion of bridge portion 50. Flyer layer 52 is then placed over bridge portion 50. As stated above, buffer material 68 acts to prevents migration of the conductive coating 70 into the material of the conductive layer 66 and vice versa. Buffer material 68 also acts to better adhere flyer layer 52 on bridge portion 50 where the conductive coating material is absent.

Substrate 54 is preferably made of a ceramic material, sticking layer 64 may be made of a titanium-tungsten composition, conductive layer 66 is preferably made of copper, buffer layer 68 is also typically a titanium-tungsten composition, conductive coating 70 is usually gold, and flyer layer 52 is typically made of a polyimide material but these materials of the preferred embodiment are not limitations of the subject invention.

Accordingly, in the subject invention, the buffer composition 68 between the material of conductive lands 42 and 44 and the material of coating 70 prevents the material of coating 70 from migrating into the material of the conductive lands and vice versa to retain the corrosion resistance properties of the coating and the electrical properties of the coated wide area lands. By removing the coating 70 from bridge portion 50, buffer layer 68 is exposed and assists in adhering flyer plate 52 to bridge portion 50 and also prevents etchants used in the manufacturing process from adversely effecting the material (e.g., copper) of the bridge portion 50. Removal of coating layer 70 from bridge portion 50 also results in the advantage that less energy is required to make a plasma which accelerates the flying plate portion of the flyer layer into an explosive. In this way, a larger shock wave can be produced to detonate an explosive. Conversely, less energy is required to provide the same shock wave to an explosive as a conventional chip slapper with a gold coating on the bridge portion and, as a result, smaller systems can be designed.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims:

What is claimed is:

1. A chip slapper comprising:

a substrate;

a sticking layer on the substrate;

a conductive layer on the sticking layer in the shape of two lands separated by a bridge portion between the two lands;

a buffer material on the conductive layer;

a coating on the buffer layer extending across at least a substantial portion of the two lands but absent from the bridge portion; and a flyer layer over the bridge portion such that the buffer material prevents migration of the material of the coating into the material of the conductive layer and vice versa and adheres the flyer layer on the bridge portion where the coating is absent.

2. The chip slapper of claim 1 in which the substrate is made of a ceramic material.

3. The chip slapper of claim 1 in which the sticking layer is made of a titanium-tungsten composition.

4. The chip slapper of claim 1 in which the conductive layer is made of copper.

5. The chip slapper of claim 1 in which the buffer material is a titanium tungsten composition.

6. The chip slapper of claim 1 in which the coating includes gold.

7. The chip slapper of claim 1 in which the flyer layer is made of a polyimide material.

8. The chip slapper of claim 1 in which the material of the sticking layer and the buffer material are the same.

9. A chip slapper comprising:

a substrate;

a conductive layer on the substrate in the shape of two lands separated by a bridge portion between the two lands;

a coating on the lands of the conductive layer but absent from the bridge portion; and a flyer layer over the bridge portion.

10. The chip slapper of claim 9 further including a sticking layer on the substrate under the conductive layer to adhere the conductive layer to the substrate.

11. The chip slapper of claim 9 further including a buffer material between the coating and the conductive layer to prevent migration of the material of the coating into the material of the conductive layer and vice versa in the area of the lands.

12. The chip slapper of claim 11 in which the buffer material extends across the bridge portion where the coating is absent to promote adhesion of the flyer layer to the bridge portion.

13. The chip slapper of claim 9 in which the substrate is made of a ceramic material.

14. The chip slapper of claim 9 in which the conductive layer is made of copper.

15. The chip slapper of claim 9 in which the coating includes gold.

16. The chip slapper of claim 9 in which the flyer layer is made of a polyimide material.

17. The chip slapper of claim 10 in which the sticking layer is made of a titanium-tungsten composition.

18. The chip slapper of claim 11 in which the buffer material is a titanium tungsten composition.

19. A chip slapper comprising:

a substrate;

a conductive layer on the substrate in the shape of two lands separated by a bridge portion between the two lands;

a buffer material on at least the bridge portion of the conductive layer; and a flyer layer over the bridge portion such that the buffer layer promotes adhesion of the flyer layer to the conductive layer.

20. The chip slapper of claim 19 further including a protective coating on the lands of the conductive layer to protect the conductive layer against corrosion in the area of the two lands but absent from the bridge portion to facilitate securing the flier layer to the bridge portion.

21. The chip slapper of claim 20 in which the buffer material extends between the conductive layer and the protective coating in the area of the lands to prevent migration of the material of the protective coating into the material of the conductive layer and vice versa.

22. The chip slapper of claim 19 further including a sticking layer between the substrate and the conductive layer to promote adhesion between the conductive layer and the substrate.

23. The chip slapper of claim 19 in which the substrate is made of a ceramic material.

24. The chip slapper of claim 19 in which the conductive layer is made of copper.

25. The chip slapper of claim 19 in which the buffer material is a titanium tungsten composition.

26. The chip slapper of claim 19 in which the flyer layer is made of a polyimide material.

27. The chip slapper of claim 20 in which the protective coating is gold.

28. The chip slapper of claim 22 in which the sticking layer is made of a titanium-tungsten composition.

29. A method of making a chip slapper, the method comprising:

depositing a sticking layer on a substrate;

depositing a conductive layer on the sticking layer;

depositing a buffer material on the conductive layer;

coating the conductive layer;

etching the sticking layer, the conductive layer, the buffer layer, and the coating into the shape of two lands separated by a bridge portion between the two lands;

removing the coating from the bridge portion to reveal the buffer material; and attaching a flyer layer to the bridge portion.

* * * * *